US008348449B2

(12) United States Patent
McCorkle et al.

(10) Patent No.: US 8,348,449 B2
(45) Date of Patent: Jan. 8, 2013

(54) FLASHLIGHT MOUNTING SYSTEM

(76) Inventors: Christopher McCorkle, Scottsdale, AZ (US); Christopher M. Stalzer, Scottsdale, AZ (US); Thomas P. Muday, Scottsdale, AZ (US)

( * ) Notice: Subject to any disclaimer, the term of this patent is extended or adjusted under 35 U.S.C. 154(b) by 69 days.

(21) Appl. No.: 12/758,957

(22) Filed: Apr. 13, 2010

(65) Prior Publication Data

US 2010/0271832 A1 Oct. 28, 2010

Related U.S. Application Data

(60) Provisional application No. 61/214,384, filed on Apr. 22, 2009.

(51) Int. Cl.
*F21V 21/0084* (2006.01)

(52) U.S. Cl. ..... 362/106; 362/191

(58) Field of Classification Search ..... 362/103, 362/105, 106, 108, 157, 177, 190, 191, 197, 362/200, 287, 396, 418, 419; 224/181
See application file for complete search history.

(56) References Cited

U.S. PATENT DOCUMENTS 4,793,007 A * 12/1988 Barnett ..... 2/422
4,991,068 A * 2/1991 Mickey ..... 362/106
4,998,187 A * 3/1991 Herrick ..... 362/103
5,463,538 A * 10/1995 Womack ..... 362/106
5,658,065 A * 8/1997 Jamieson ..... 362/106
D481,303 S 10/2003 Fell et al.
6,764,194 B1 * 7/2004 Cooper ..... 362/105
7,156,536 B1 1/2007 McCorkle
7,425,082 B1 * 9/2008 Jones ..... 362/285
7,478,918 B2 1/2009 Petzl et al.
7,677,755 B2 * 3/2010 Kim ..... 362/190
2005/0254238 A1 * 11/2005 Parker et al. ..... 362/191
2007/0177375 A1 8/2007 Petzl et al.
2009/0283558 A1 * 11/2009 Wanzer ..... 224/181

* cited by examiner

*Primary Examiner* — Hargobind S Sawhney
(74) *Attorney, Agent, or Firm* — Schmeiser, Olsen & Watts LLP

(57) ABSTRACT

A flashlight mounting system for a helmet of the type used by firefighters. The system has a light holder which is engageable with an adaptor on or secured to a helmet. A coupling is adjustable relative to the holder at engaging teeth and grooves to adjust the light and the path of the light beam. The adaptor and holder may be manually disengaged to change the orientation of the light or to allow the user to manually use the light and reattach the light in the original position without removing the helmet in dangerous environments and other environments.

Inserts may be provided to adopt the light-receiving section to various styles, types and shapes of flashlights. The system allows the user to quickly adjust the flashlight and also allows the use of the light and holder with different helmets.

11 Claims, 14 Drawing Sheets

FLASHLIGHT MOUNTING SYSTEM

CROSS-REFERENCE IS MADE TO RELATED APPLICATION

This application is based on U.S. Provisional Patent Application Ser. No. 61/214,384, filed Apr. 22, 2009, of the same title.

FIELD OF THE INVENTION

The present invention relates a flashlight mounting system and more particularly to a versatile mounting system for removably attaching a flashlight to headgear, particularly protective helmets such as those worn by firefighters and others.

BACKGROUND OF THE INVENTION

Flashlights are commonly used by firefighters, construction workers and others in areas or situations where illumination is required. Firefighters often enter dark or smoke-filled areas and find it necessary to use a flashlight for illumination. Firefighters and others also require the ability and freedom to use both hands to perform their duties. If it becomes necessary for these individuals to hold a flashlight in one hand for illumination, the individual's ability to effectively operate equipment and safely perform duties in these conditions may be seriously impaired.

Various types of lights are secured to the fronts of helmets such as mining helmets and other types of helmets. Brackets and holders have been developed and can be found in the prior art which are more specifically intended for use with helmets of the type worn by firefighters. Once such holder is shown and described in U.S. Pat. No. 7,156,536 ('536 patent), which discloses a light holder for a brimmed helmet of the type worn by firefighters. The holder has an aperture for receiving the barrel of a light. A mounting slot extends with respect to the aperture so that when the mounting slot is engaged in the brim, the light is maintained at eye level, below the helmet brim and in an out-of-the-way position to minimize the possibility of entanglement. Setscrews or other fasteners may be provided for securement of a light to the holder and the holder to the helmet. Other types of helmets, headgear or light holders are also discussed in the '536 patent.

While the flashlight holder shown in the '536 patent represents a substantial improvement in the state of the art and which holder has achieved recognition and acceptance, particularly by firefighters, there are a number of features according to the present invention which provide further benefits and efficiencies.

BRIEF SUMMARY OF THE INVENTION

Briefly, an embodiment of the present invention provides a flashlight mounting system for a helmet having a light-receiving section or holder, adjustable coupling and an adaptor. The holder has a body which defines an opening for receiving and removably holding the barrel of a flashlight. The body may be provided with a fastener such as a thumb screw to secure the light in place once it has been inserted in the opening in the body.

Holder inserts may be provided which can be placed within the opening of the holder to alter the effective size of the opening so lights of various sizes and shapes may be secured in the holder. The holder carries a connector which includes an annular connector ring. Within the annular connector ring is an opening in the wall of the holder having a plurality of circumferentially extending, spaced-apart projections or teeth. The connector ring has frictional retainer means such as a groove or ridge engageable with a cooperating groove or ridge on a ring on an adaptor so the holder and adaptor may be engaged or disengaged to separate the flashlight and holder from the helmet.

An adjustable coupling is insertable within the opening in the holder from the interior of the holder. The adjustable coupling has projections or teeth which are selectively engageable with the projections or teeth within the connector ring. The coupling has a central projecting hub and the coupling may be angularly rotated and locked in a desired position in the opening in the holder to adjust the angular position of the light relative to the helmet. The coupling hub is oval, polygonal or other non-circular shape selected so the adaptor will not rotate. The coupling is held in place by the body of the flashlight.

The adaptor is securable to a surface, such as to the side of a helmet and has an annular outer ring and an inner seat. The inner seat has a recess with a cross-sectional configuration corresponding to the configuration of the coupling hub and is engageable with the hub of the adjustable coupling to secure the light holder in a selected position established by the position of the coupling relative to the holder. The adaptor ring has a retaining groove or ridge which, when the connector and adaptor are placed together, will frictionally secure the adaptor and holder components together in the selected position. Adjustability is achieved by positioning the coupling relative to the holder to change the relative position of the coupling and the hub. The user can position the light holder to direct the light beam along a desired path depending on personal preference and helmet design. The selected position is "locked" by manually engaging the adaptor and the connector on the light holder at the cooperating ridge and groove. If the light and the attached holder are disengaged by the user from the adaptor, the light and holder may be easily reattached to the adaptor on the helmet with the light in the same position as it was before it was disengaged so the direction of the light beam is not changed.

The adaptor is mountable to a helmet by various means including fasteners or adhesives. The adaptor may have a section configured to cooperate with an existing bracket on the helmet or the adaptor may also be integrally formed on a surface of the helmet. One of the significant advantages of the present invention is that by selectively using various connectors and couplings, the system may be secured to helmets of various styles and types. Also, the same light may be used in connection with a variety of helmets which is common practice in some countries. The light may be adjusted to align with the line of sight of the user. The use of inserts allows the holder to accommodate a variety of styles and shapes of flashlight.

BRIEF DESCRIPTION OF THE DRAWINGS

The above and other advantages and objects of the present invention will become more apparent when taken in conjunction with the following description, claims and drawings in which:

DETAILED DESCRIPTION OF THE DRAWINGS

The present invention will be described in connection with various styles of helmets of the type worn by firefighters. It is understood that the holder of the present invention may be used with other types of helmets and headgear such as those worn by construction workers, miners and the like.

Figure 11:
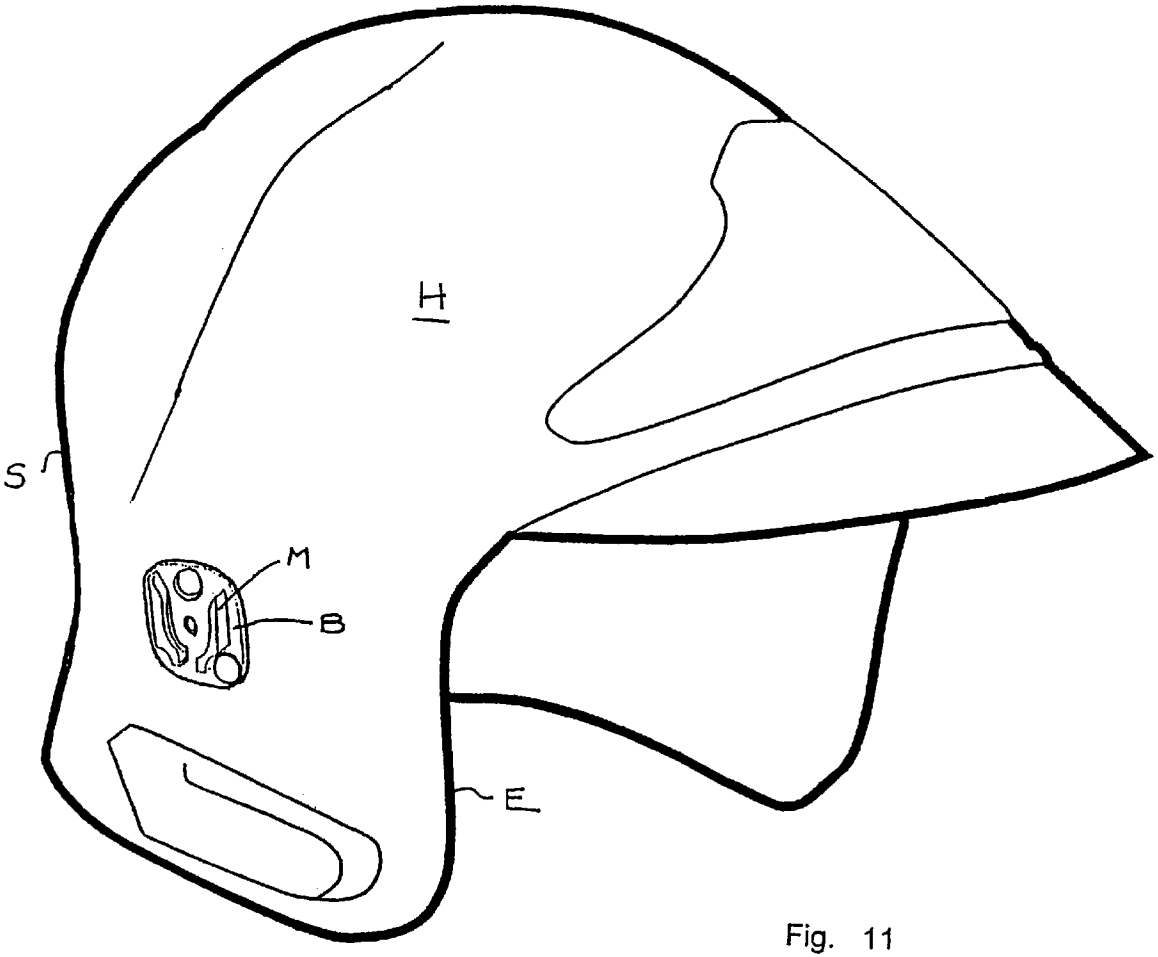
FIGS. 11 and 12 illustrate several representative styles of firefighters helmets with which the system may be used showing attachments for the mounting system of the present invention.

One style of firefighter's helmet is generally shown in FIG. 11. This style of helmet is more commonly used by firemen in European countries. The helmet H of FIG. 11 includes a shell S which encompasses the wearer's head and is fabricated from a suitable impact-absorbing material. The lower edge E of the helmet projects downwardly, vertically extending around the wearer's neck and below the wearer's ear. These types of helmets are often provided with a mounting bracket B which may be integrally formed with the helmet or attached by fasteners as shown having flanges M or other features for attaching an accessory.

Figure 12:
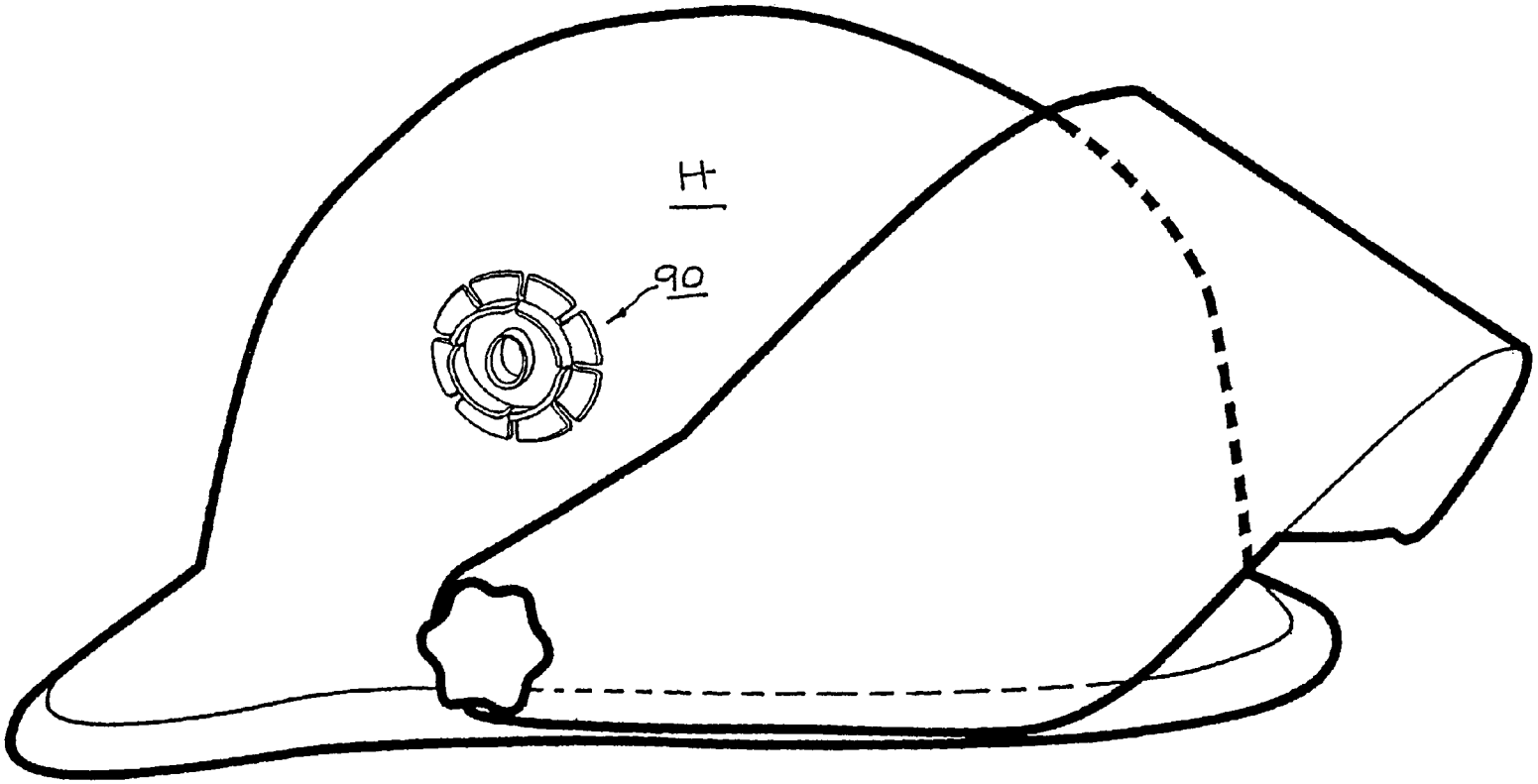

Firefighters helmets of the type more commonly found in the United States are shown in FIG. 12 having a more horizontally extending lower rim R. This type of helmet may also have some type of mounting fixture or bracket attached to the helmet such as adaptor 90 which is a component of the present system as will be explained below.

The mounting system of the present invention provides versatility and is designed for use with types of helmets as shown in FIGS. 11 and 12, as well as other types of helmets. The mounting system of the present invention accommodates various sizes and types of flashlights and, further, quickly facilitates detachment and re-attachment of a light without removal of the helmet, even in difficult conditions in which firefighters and others work. The light, when removed, may be used as a hand-held light or the direction of the light path may be adjusted in accordance with the preference of the user and remounted on the helmet or may be quickly reattached with the position of the light unchanged.

Referring to the drawings, particularly FIGS. 1 to 9, the mounting system of the present invention is generally designated by the numeral 10. The mounting system has multiple components including a light-receiving member or light-holder 12, an adaptor 14 and a coupling 16.

Figure 3:
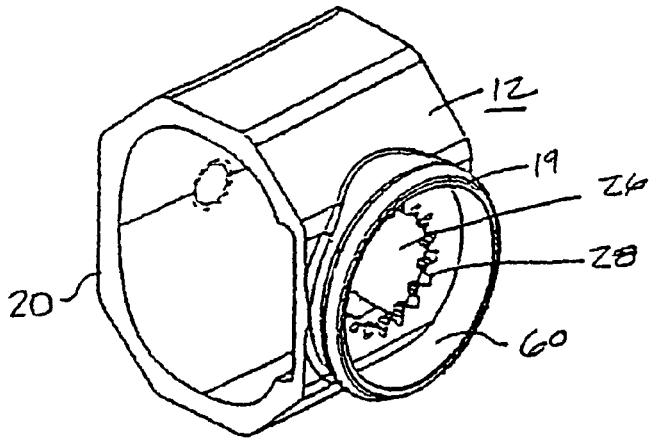
FIGS. 3 and 4 are perspective views of a light holder.
Figure 5:
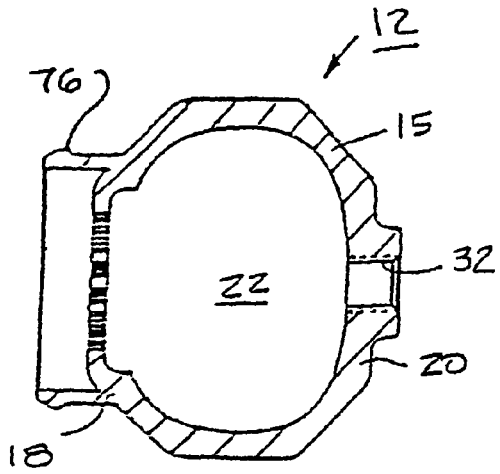
FIG. 5 is a cross-sectional view of the light holder taken along lines 5-5 of FIG. 4.
Figure 4:
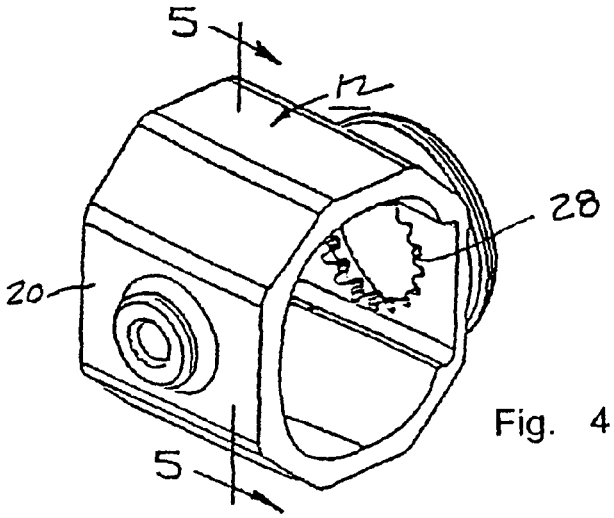
Figure 6:
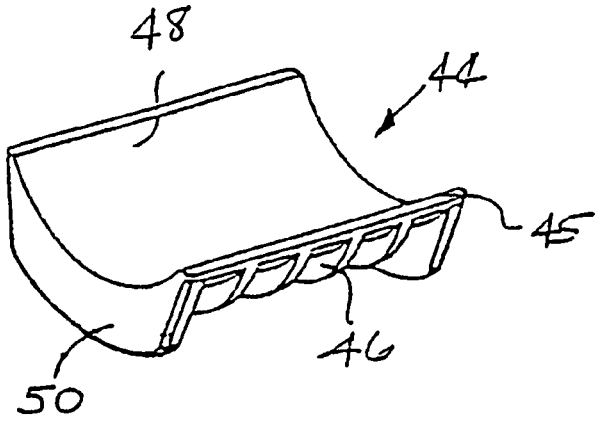
FIG. 6 is a perspective view of a representative insert which may be used with the light holder of the present invention.

Holder 12, as best seen in FIGS. 3, 4 and 5, has a housing or body 15 defining a receptacle or opening 22 for a flashlight. The light holder 12 may be any suitable shape and is shown as being generally octagonal having opposed sidewalls 18 and 20. Opening 22 is shown as being generally oval and is configured to conform to the cross-sectional size and shape of many of the standard types of flashlights used by firefighters. However, as will be explained, selected inserts 44 may be positioned within the opening to adapt the holder opening 22 to accommodate flashlights of various sizes and shapes.

Figure 2:
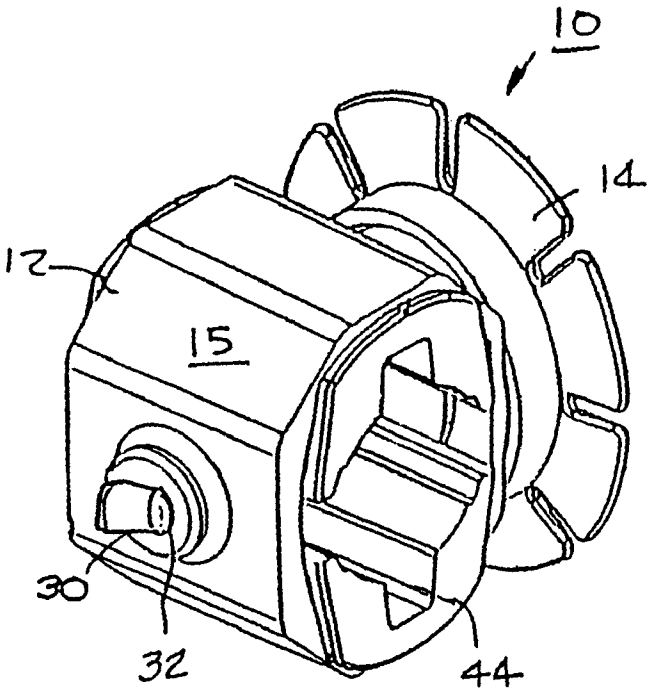
FIGS. 1 and 2 are perspective views of an embodiment of the light mounting system of the present invention shown without a light in place.

The exterior surface of sidewall 18 is provided with an attached or integrally formed connector 19 which is shown as having a generally circular ring 60 extending about opening 26 in sidewall 18. A plurality of circumferential projections or teeth 28 extend around the edge of the opening. The opposite sidewall 20 carries a fastener 30, as best seen in FIG. 2, having a body which is in threaded engagement with the sidewall at 32. The fastener 30 is preferably a thumb screw which can be manipulated by the user even when wearing gloves, is loosened when a flashlight is inserted into the opening 22 and may be tightened to secure the flashlight in place. The holder 12 may be any suitable material such as a heavy-duty, heat-resistant plastic or a metal such as aluminum, and may be fabricated by casting, molding, machining or other techniques.

Figure 1:
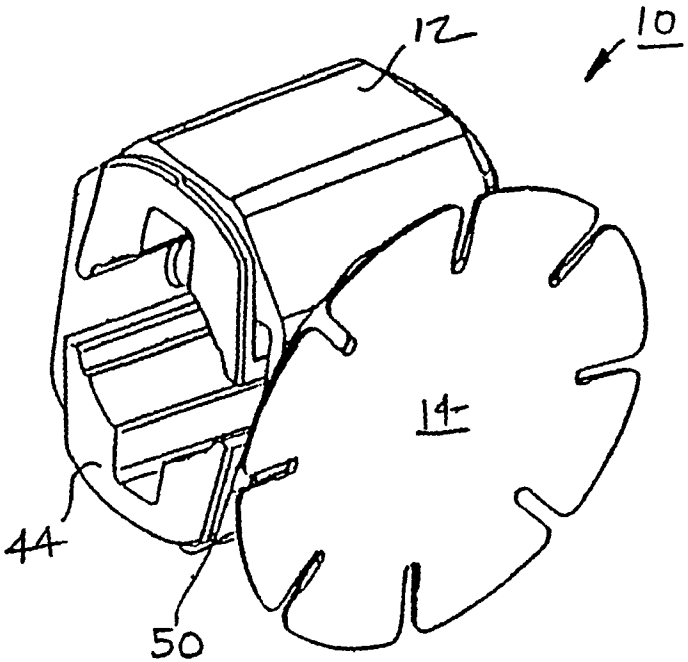
Figure 9:
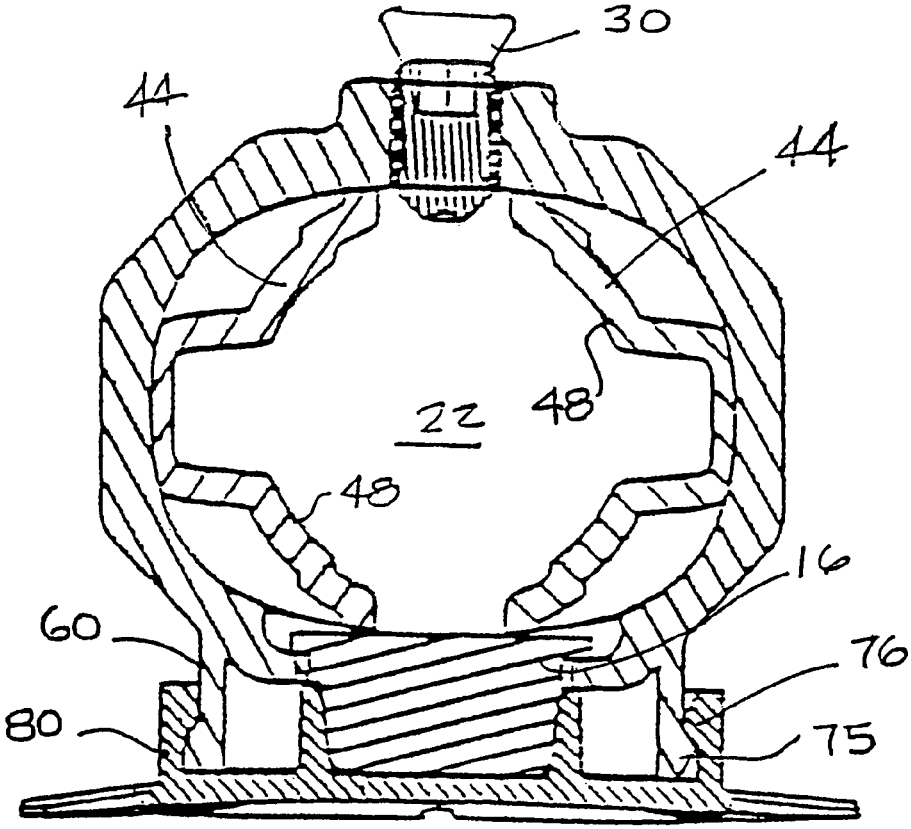
FIG. 9 is a cross-sectional view showing a holder, coupling and adaptor in an engaged position as would be mounted on a helmet.
Figure 8:
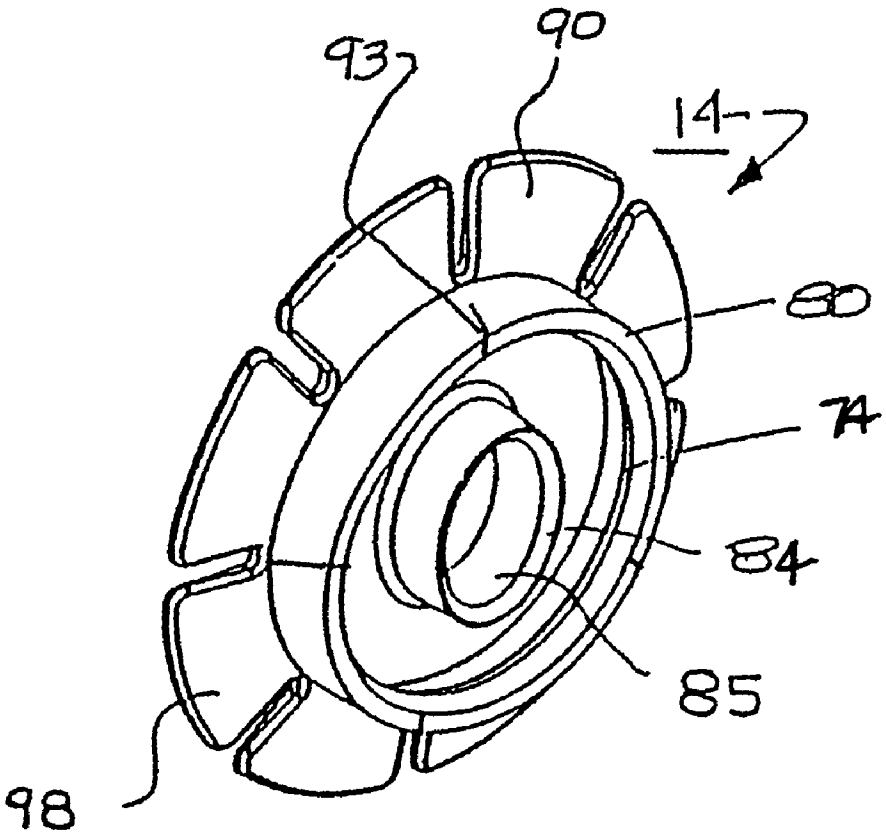
FIG. 8 is a perspective view of an adaptor.
Figure 7:
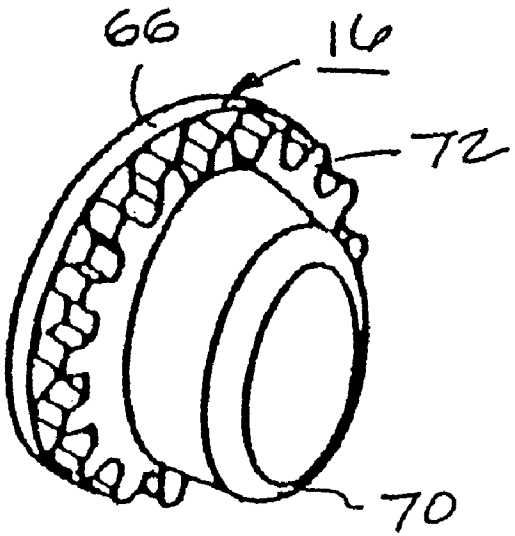
FIG. 7 is a perspective view of an adjustable coupling.

In order to provide versatility and adapability to various styles, types and shapes of lights, the holder 12 may be used with various inserts. The inserts 44, are seen in FIGS. 1, 2, 6 and 9, and one or more inserts are positionable within the opening 22 when the shape of the barrel of the light does not conform to the opening 22. A selection of individual inserts may be provided to or made available to the user. Each of the inserts 44 has a body 45 having an outer surface 46 generally conforming to or permitting the outer surface to be positioned within the opening 22, as best seen in FIG. 9. The inner surfaces 48 of the inserts are configured to conform to the size and shape of a particular flashlight. The ends of the insert are provided with flanged end walls 50 which can be frictionally engaged against the opposite ends of the holder 12 to secure the inserts in place, as seen in FIGS. 1 and 2. The inserts can be removed from the opening so the holder 12 may be used without inserts or may be used with other inserts having various configurations to accommodate other sizes, types and styles of lights.

Figure 13:
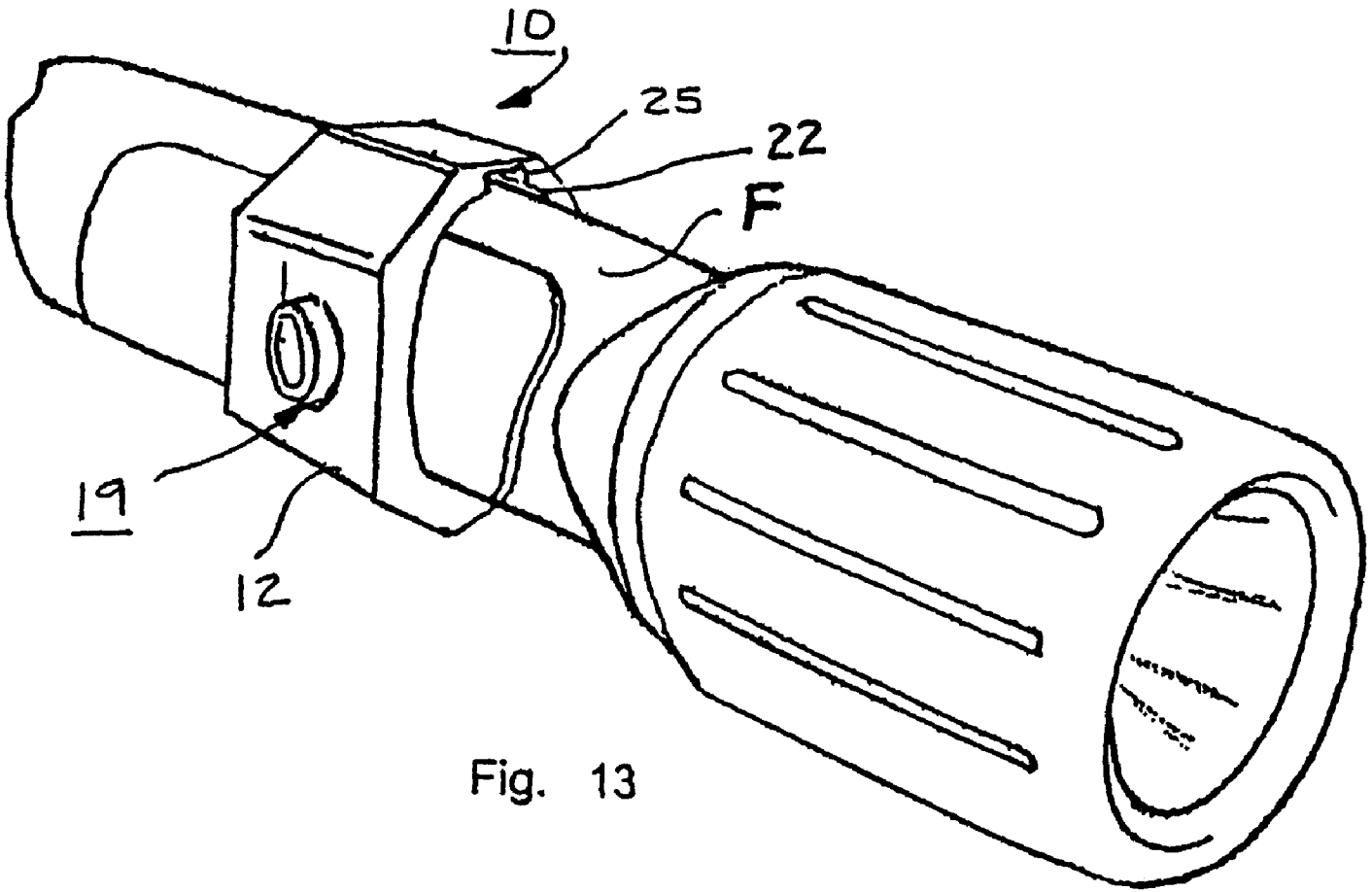
FIG. 13 shows a representative flashlight inserted in the holder of the mounting system of the present invention.

The inserts 44 may also be secured to the light-receiving section by other means such as providing the opposite upper and lower surfaces of the opening 22 with axially extending slots or keyways 25, as seen in FIG. 13, having a dovetail configuration which taper to receive a corresponding key on the insert. The inserts may be molded from a resilient material to frictionally engage the light and also to provide cushioning for the contained light or the inserts may be one or several spring clips which engage and secure the light within the holder.

As explained, the sidewall 20 of the body 15 of the holder 12 carries a connector ring 19 which has a generally annular wall 60. Concentrically located within the annular wall 60 is opening 26 having a plurality of peripheral projections or teeth 28. An adjustable coupling 16, shown in FIG. 7, has a circular flange 66 and a projecting hub 70. A plurality of projections or teeth 72 extend around the hub 70 on the flange and are spaced to engageably conform to teeth 28 extending around opening 26 in the sidewall of the holder 12. The projections or teeth 28, 72 cooperate and are engageable locking members to "lock" the position of the coupling 16 relative to the holder 12 establishing the position of the light. The coupling is held in place by the barrel of the flashlight. The light may be removed and coupling disengaged and the position of the coupling 16 can be rotatively adjusted relative to the holder 12 and the orientation of hub 70. Hub 70 is non-circular and is shown as oval but may have other cross-sectional shapes such as polygonal to facilitate adjustment of the light holder 12. The hub 70 seats in a complementary shaped recess 85 in the seat 84 of the adaptor 14. When the adaptor is engaged with the coupling, as seen in FIG. 9, the cooperating ridges and grooves 75, 76 on the adaptor ring 80 and the connector ring 19 are frictionally engaged, securing the components together and securing the coupling 16 in a selected rotative position to properly direct the beam of light. The periphery of the annular ring 80 of the adaptor 14 may be provided with one or more slots 93 to facilitate the engagement of the adaptor and the connector.

The rear side of the adaptor 14 is provided with a mounting pad 90 for securement to the helmet. The mounting pad 90 may be a flat pad, but is preferably concave, to fit against the curved surface of a helmet. The pad is secured to a location on the side of helmet H by a suitable, aggressive adhesive, as seen in FIG. 12. The pad 90 may have a plurality of peripheral sections 98 which may be trimmed to accommodate mounting on particular helmet styles or at a particular location on a helmet.

Figures 10A, 10B, 10C, 10D:
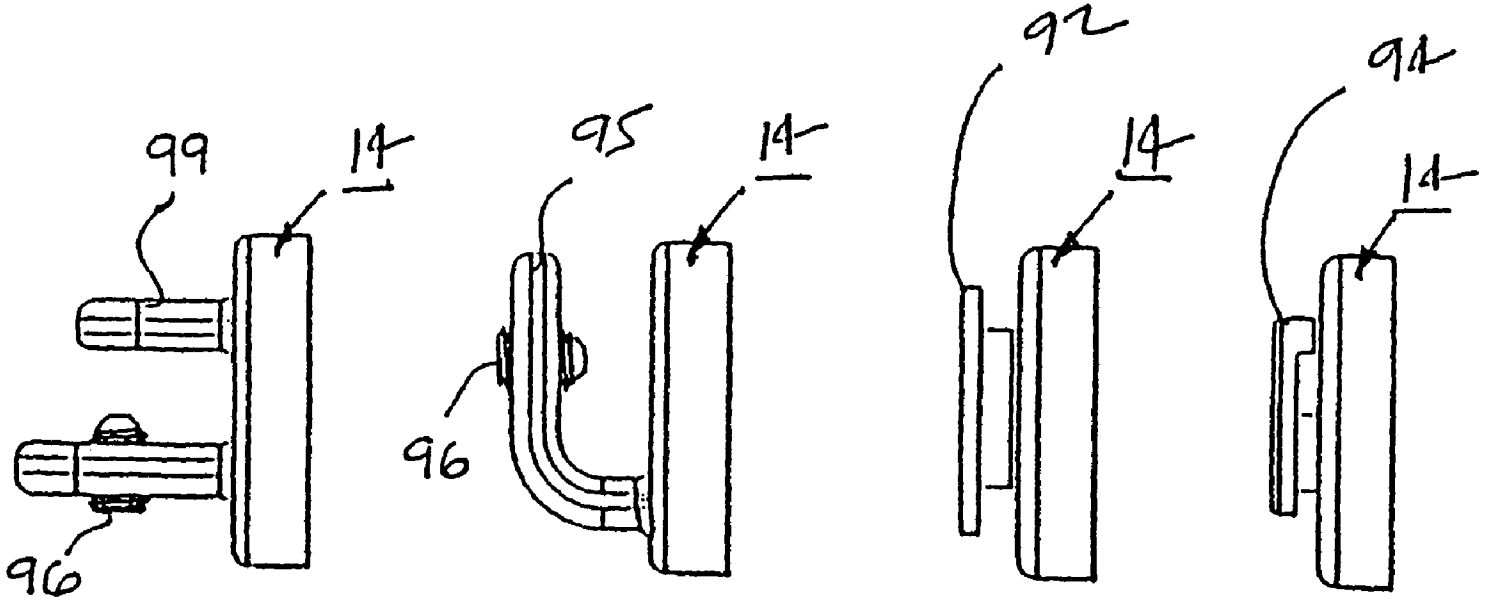
FIGS. 10A to 10D illustrate various alternate mountings for attaching the adaptor to a helmet.

Alternatively, the adaptor 14 may also be provided with flanges 92 and 94, complementary to be removably received in bracket B mounted on the helmet H of the type shown in FIG. 11. FIGS. 10C and 10D are side views of adaptors 14 which illustrate representative mounting flanges 92, 94 that may be provided on the adaptor 14 which, in other respects, is as described above. The adaptor may also be clamped to the helmet brim using clamps 95 or 99 with fasteners 96 as seen in FIGS. 10A and 10B. The particular mounting type and configuration will depend on the type and style of helmet. Adaptor 14 may also be integrally formed as part of the helmet, as seen in FIG. 12.

In use, the body or barrel of a selected flashlight F is inserted within the opening 22 in the holder 12, as seen in FIG. 13, and may be secured by fastener 30. If required, a selected insert 44 can first be inserted in the opening 22 to accommodate the particular style of light. The adaptor 14 is secured to a helmet at mounting pad 90 by use of an adhesive or by attachment to an existing bracket on the helmet or by clamps as shown in FIGS. 10A, 10B. The user will initially insert the adjustable coupling 16 into the opening 28 in the sidewall of the holder 12. The relative position of the coupling 16 to the holder 12 can be rotatively adjusted as required to establish the position of the light F and the direction of the light beam. After the light is inserted in the holder, the adaptor and holder are "snapped" together in frictional engagement at ridges and grooves 75, 76 on rings 60, 80. When the user wishes to use the light independent of the helmet, a separating manual force is applied which unseats the engagement of the adaptor and holder. The components can be re-engaged with the light in the same position. If adjustment of the position of the light is required, the light is removed from the holder and the coupling 16 is repositioned rotating the hub to a new position to redirect the beam of the flashlight once the components are reassembled. The circular configuration of the annular ring 19 and the flange on the adaptor permit relative rotation of the components.

Figure 14:
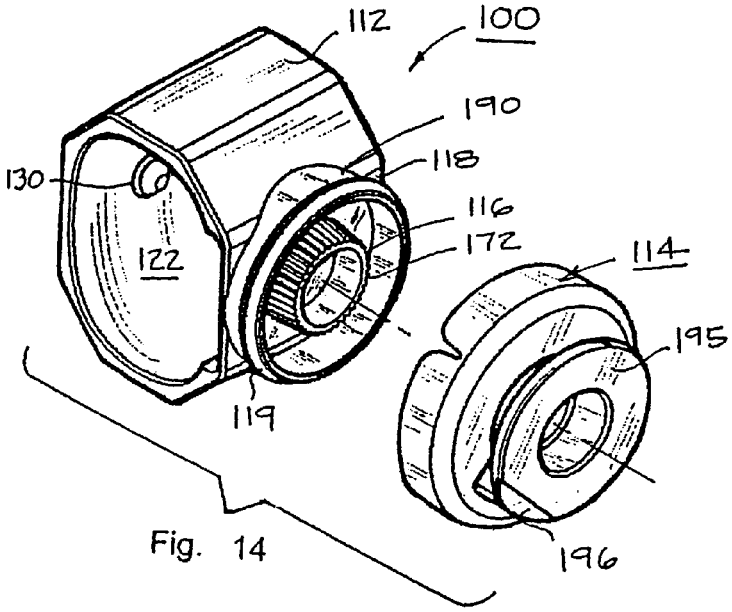
FIG. 14 is an exploded view of another embodiment of the mounting system showing an adaptor and connector.
Figure 15:
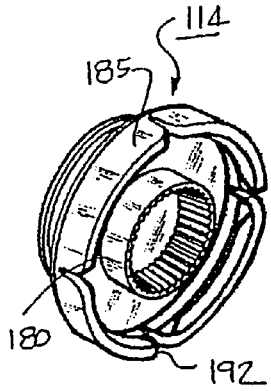
FIG. 15 is a perspective view of the connector, as seen in FIG. 14, viewed from the opposite side.

FIGS. 14 and 15 show another embodiment of the present invention designated by the numeral 100 having a light holder 112 and adaptor 114. The holder has an opening 122 for receipt of a flashlight which may be secured by fastener 130. The body of the holder 112 has an ring 119 on one sidewall 118 with an annular ridge or groove 190. Concentrically located within ring 119 is coupling 116 which is fixed. Coupling 116 has a plurality of axial teeth or splines 172 which are engageable with complementary grooves 180 on the interior wall of hub 184 of connector 114, as seen in FIG. 15, to "lock" the light in a selected position. Connector 114 has a peripheral slotted flange 185 frictionally engageable with annular ring 119 of the holder 112 at cooperating features 190, 192, which are shown as a ridge and a groove. The connector 114 has a flange 195 which is removably engageable with a helmet bracket B of the type shown in FIGS. 11 and 12. Flange 195 may be chamfered at 196 to facilitate insertion in a bracket of the type shown in FIG. 11. Adjustment of the light secured within the holder 112 is accomplished by applying an outward separating force to the light and holder to disengage the holder from the adaptor. The light can then be placed in the desired position and the holder and adaptor re-engaged at splines 116 and grooves 180.

Figure 16:
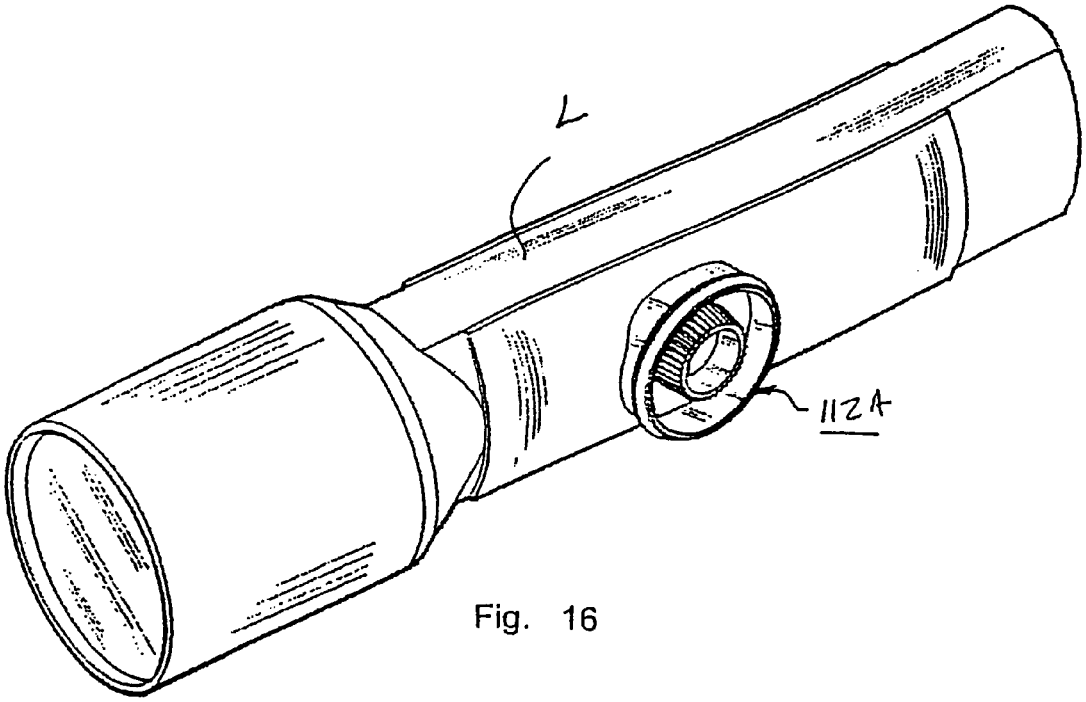
FIG. 16 is a perspective view of a flashlight in which an adaptor compatible with the holder shown in FIG. 14 is formed as an integral component of the flashlight body.

The holder may also be integrally formed as a component of the light extending from the barrel of the light as seen in FIG. 16. The holder 112A, as seen in FIG. 16, is in other respects is as described with reference to holder 112 with reference to FIGS. 12 and 13. Securement, adjustment and removal of the light L to an adaptor, such as adaptor 114, is also accomplished as described.

Figure 17:
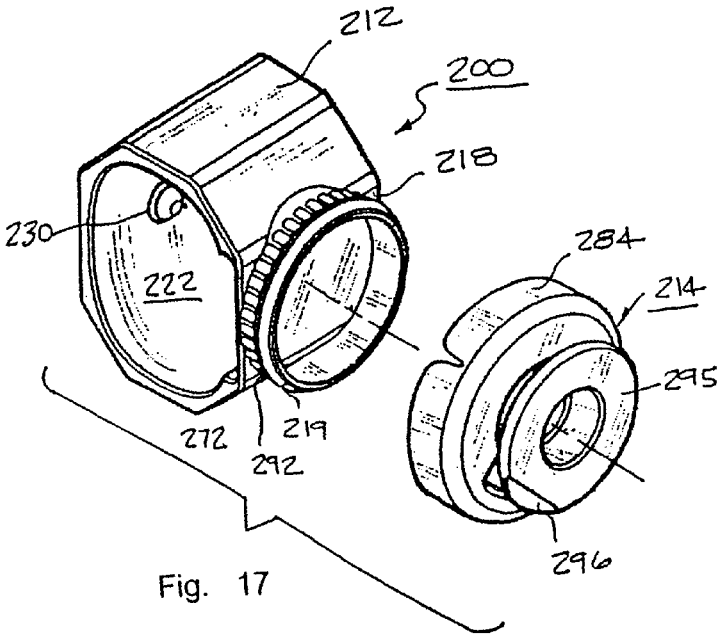
FIG. 17 is an exploded view of another embodiment of the mounting system showing an adaptor and connector.
Figure 18:
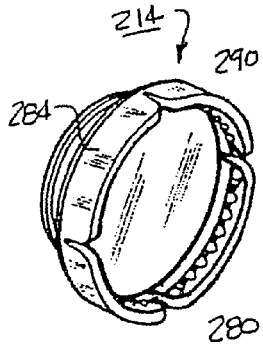
FIG. 18 is a perspective view of the connector, as seen in FIG. 17, as viewed from the opposite side.
Figure 19:
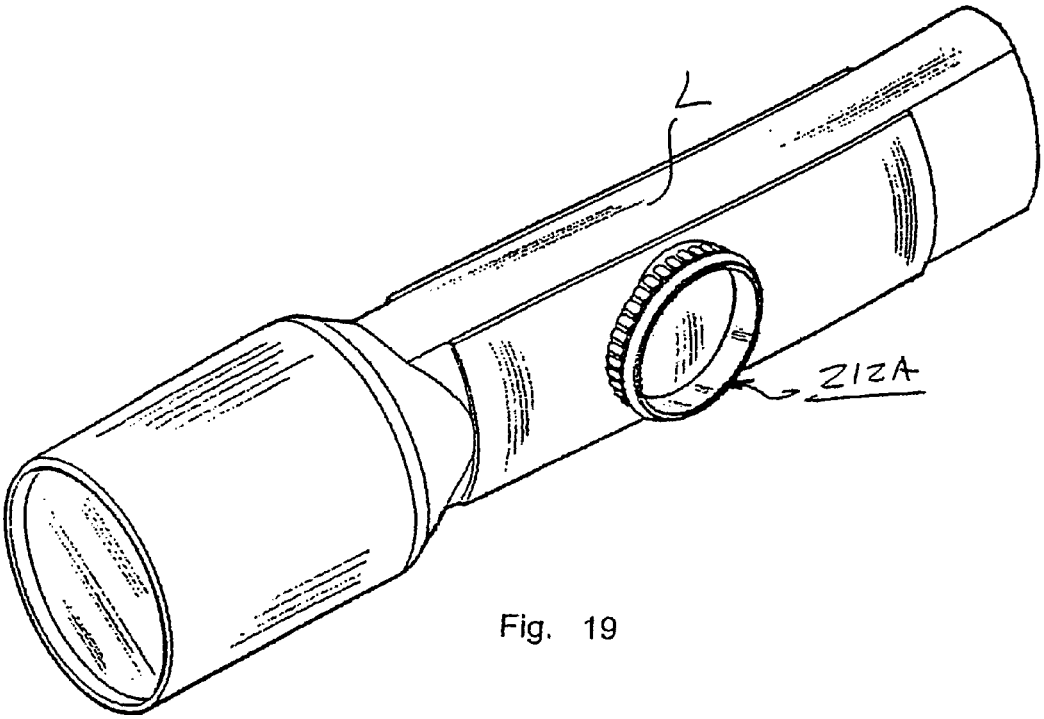
FIG. 19 is a perspective view of a flashlight in which an adaptor compatible with the holder shown in FIG. 17 is formed as an integral component of the flashlight body.

FIGS. 17 and 18 show another embodiment of the mounting system present invention designated by the numeral 200 having a holder 212 and adaptor 214. The holder has an opening 222 for receipt of a flashlight which may be secured by fastener 230. The body of the holder 212 has an annular ring 219 on sidewall 218. Ring 219 has a plurality of peripheral teeth or ridges 272 which are engageable with complementary grooves 280 on the interior of wall 284 of adaptor 214 to "lock" the holder in a selected position relative to the adaptor. Adaptor 214 has a wall 284 engageable with annular ring 219 of the holder 212 at cooperating ridge and groove features 290, 292. The connector 214 has a flange 295 which is removably engageable with helmet bracket B of the type shown in FIGS. 11 and 12. Flange 295 may be chamfered at 296 to facilitate insertion in a bracket of the type shown in FIG. 11. Adjustment of the light secured within the holder 212 is accomplished by applying a manual, outward separating force to the light and holder 212 to disengage the holder from the adaptor. The light can then be used as a handheld light and then replaced in the desired position and the holder and adaptor re-engaged with the teeth and grooves 272, 280 of the coupling and hub engaged to maintain the position of the light. The ridge and groove 290, 292 of the annular wall of the holder and adaptor are also frictionally engaged to hold the components together. The holder may also be integrally formed as a component of the light extending from the barrel of the light as seen in FIG. 19 and identified by the designation 212A and cooperates with an adaptor such as adaptor 214 mounted on a helmet. The holder 212 in other respects is as described with reference to FIGS. 17 and 18 and securement, adjustment and removal of the light is also accomplished as described.

Figures 20, 21:
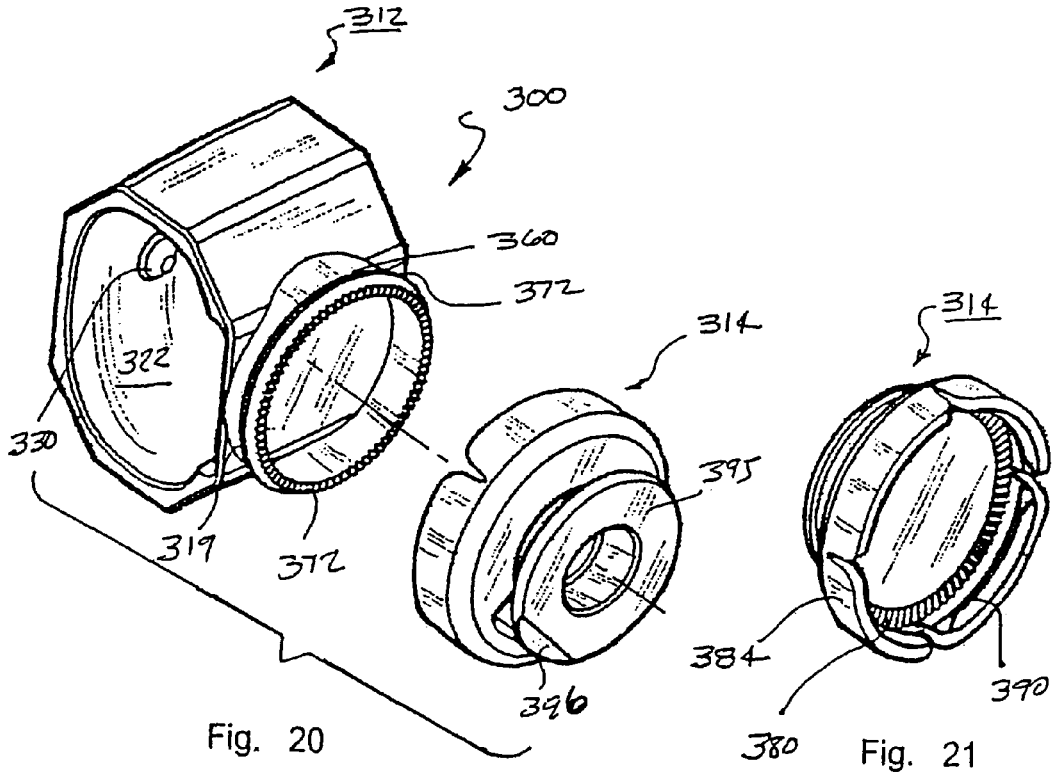
FIG. 20 is an exploded view of another embodiment of the mounting system showing an adaptor and connector.
FIG. 21 is a perspective view of the connector, as seen in FIG. 20, as viewed from the opposite side.
Figure 22:
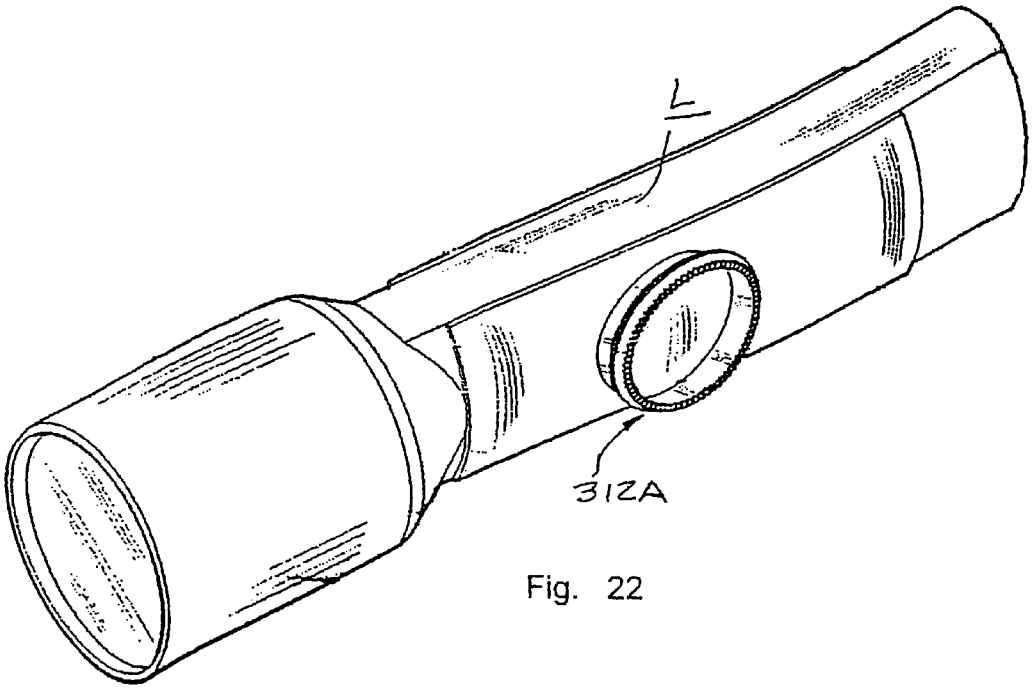
FIG. 22 is a perspective view of a flashlight in which an adaptor compatible with the holder shown in FIG. 20 is formed as an integral component of the flashlight body.

FIGS. 20 to 22 show another embodiment of the present invention designated by the numeral 300 having a holder 312 and adaptor 314. The holder has an opening 322 for receipt of a flashlight which may be secured by fastener 330. The body of the holder 312 has an annular ring 319 on one sidewall 318. The edge of ring 319 has a plurality of axial teeth or ridges 372 which are engageable with complementary grooves 380 on the interior of annular wall 384 of adaptor 314 to selectively position the light and holder. Wall 384 is frictionally engageable with annular ring 360 of the holder 312 at cooperating ridge and groove 390, 372. Adaptor 314 has a flange 395 which is removably engageable with helmet bracket B of the type shown in FIGS. 11 and 12. Flange 395 may be chamfered at 396 to facilitate insertion in a bracket of the type shown in FIG. 11. Removal of a light secured within the holder 312 is accomplished by applying an outward separating force to the light and holder to disengage the holder from the adaptor. The light can then be placed in the desired position and the holder and adaptor re-engaged with the teeth and grooves of the holder and adaptor.

The holder 312 may also be integrally formed as a component of the light extending from the barrel of the light L, as seen in FIG. 22, or permanently attached. The holder 312A in other respects is as described with reference to FIGS. 20 and 21 and securement, adjustment and removal of the light is also accomplished as described.

From the foregoing, it will be seen that the present invention provides an improved light holder for flashlights for use with various styles and types of helmets. The system of the invention has a number of significant advantages and is versatile to accommodate lights of various sizes, shapes and types. The system allows the user to quickly, manually remove the light from his or her helmet for handheld use. The light can be re-engaged with the adaptor on the helmet without removal of the helmet in dark and sometimes dangerous conditions where removal of the user's helmet would pose a serious safety risk.

The system also is adaptable so that it may be used with helmets of various styles. The system secures a light in a convenient position generally aligned with the eye level of the wearer, either on the helmet or beneath a helmet brim making the light secure and less subject to becoming dislodged or entangled in wires or other structures that the user may encounter while wearing a helmet equipped with the light holder of the present invention.

In the event the light does become entangled, it may be quickly detached from the helmet by applying a manual force of about 12 lbs. to overcome the frictional engagement between the adaptor and connector, providing safety and break-away protection to the wearer.

While the system of the present invention has been described primarily for use with helmets to provide a versatile mounting, the system of the present invention may be used other applications where it is desirable to provide an adjustable and detachable light source. Such applications include, but are not limited to, shop applications, illumination of poorly lighted areas as well as hobby uses.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A mounting system for detachably securing a flashlight to a helmet, the mounting system comprising:

(a) a holder having a body for holding a flashlight, said body having a connector with first engagement means;

(b) an adaptor having a mount securable to the helmet, said adaptor having second engagement means;

(c) a coupling adjustably positionable relative to said holder, one of said coupling and adaptor having a seat and the other having a hub cooperable to position the holder relative to the helmet to orient the light in a selected position;

(d) said first and second engagement means frictionally engageable to detachably secure said holder to said adaptor wherein said first and second engagement means comprise a groove and a projection, each on a circular surface; and removable inserts positionable in said body to accommodate flashlights of various styles, wherein the adaptor mount is a pad adhesively securable to a helmet.

2. The mounting system of claim 1 wherein said coupling is rotatively adjustable relative to the holder at interengaging grooves and projections.

3. The mounting system of claim 1 wherein the hub and seat are non-circular.

4. The mounting system of claim 1 wherein the adaptor mount is a clamp.

5. The mounting system of claim 1 wherein the adaptor mount is a fastener and whereas the helmet carries a bracket cooperable with the fastener.

6. A mounting system for detachably securing a flashlight having a barrel to a helmet, the mounting system comprising:

(a) a flashlight holder having a body defining a receptacle for holding the barrel of a flashlight, said body having an annular connector projecting therefrom, said connector having first positioning means; and (b) an adaptor having a body with a mount therein securable to the helmet, said adaptor having second positioning means cooperative with said first positioning means to detachably secure said holder in a selected position relative to said adaptor whereby the holder and light may be removed and repositioned at said positioning means.

7. The mounting system of claim 6 wherein the said first and second positioning means comprise interengaging projections and grooves.

8. The mounting system of claim 6 wherein the holder is formed as an integral component of the barrel of a flashlight.

9. The mounting system of claim 6 wherein the mount is cooperable with a bracket on a helmet.

10. The mounting system of claim 6 wherein the mount is a pad securable to a surface of the helmet.

11. A mounting system for detachably securing a flashlight to a helmet, the mounting system comprising:

(a) a holder having a body for holding a flashlight, said body having a connector with first engagement means;

(b) an adaptor having a mount securable to the helmet, said adaptor having second engagement means;

(c) a coupling adjustably positionable relative to said holder, one of said coupling and adaptor having a seat and the other having a hub cooperable to position the holder relative to the helmet to orient the light in a selected position;

(d) said first and second engagement means frictionally engageable to detachably secure said holder to said adaptor wherein said first and second engagement means comprise a groove and a projection, each on a circular surface; and (e) removable inserts positionable in said body to accommodate flashlights of various styles, wherein the adaptor mount is a fastener and whereas the helmet carries a bracket cooperable with the fastener.

* * * * *